US007882688B2

(12) United States Patent
Indiano

(10) Patent No.: US 7,882,688 B2
(45) Date of Patent: Feb. 8, 2011

(54) PROCESS FOR MANUFACTURING YARN MADE FROM A BLEND OF POLYESTER FIBERS AND SILVER FIBERS

(75) Inventor: I. Michael Indiano, Yardley, PA (US)

(73) Assignee: AG Technologies, Inc., Watchung, NJ (US)

( * ) Notice: Subject to any disclaimer, the term of this patent is extended or adjusted under 35 U.S.C. 154(b) by 31 days.

(21) Appl. No.: 12/459,068

(22) Filed: Jun. 26, 2009

(65) Prior Publication Data

US 2010/0000195 A1 Jan. 7, 2010

Related U.S. Application Data

(60) Provisional application No. 61/133,762, filed on Jul. 2, 2008.

(51) Int. Cl.
*D02G 3/02* (2006.01)

(52) U.S. Cl. ..... 57/255; 57/295

(58) Field of Classification Search ..... 57/255, 57/257, 258, 295; 19/145.5, 145.7; 428/359, 428/361

See application file for complete search history.

(56) References Cited

U.S. PATENT DOCUMENTS

| | | | | |
|---|---|---|---|---|
| 2,245,359 | A | | 6/1941 | Perry |
| 3,251,178 | A | | 5/1966 | Stirling |
| 3,347,727 | A | | 10/1967 | Bobkowicz et al. |
| 3,998,988 | A | | 12/1976 | Shimomai et al. |
| 4,017,942 | A | | 4/1977 | Clayton et al. |
| 4,042,737 | A | | 8/1977 | Forsgren et al. |
| 4,388,370 | A | | 6/1983 | Ellis et al. |
| 4,756,941 | A | | 7/1988 | McCullough et al. |
| 4,793,130 | A | * | 12/1988 | Togashi et al. ..... 57/210 |
| 5,201,169 | A | * | 4/1993 | Miyashita ..... 57/7 |
| 5,234,720 | A | | 8/1993 | Neal et al. |
| 5,372,739 | A | | 12/1994 | Neal et al. |
| 5,549,957 | A | | 8/1996 | Negola et al. |
| 5,677,058 | A | | 10/1997 | Neal et al. |
| 6,032,450 | A | * | 3/2000 | Blum ..... 57/75 |
| 6,035,493 | A | | 3/2000 | Carlton |
| 6,723,428 | B1 | | 4/2004 | Foss et al. |
| 6,815,060 | B2 | | 11/2004 | Yuuki |
| 6,946,196 | B2 | | 9/2005 | Foss |
| 7,069,714 | B2 | * | 7/2006 | De Boni ..... 57/210 |
| 7,144,830 | B2 | * | 12/2006 | Hill et al. ..... 442/205 |
| 7,592,276 | B2 | * | 9/2009 | Hill et al. ..... 442/301 |
| 2008/0209688 | A1 | * | 9/2008 | Palmer et al. ..... 19/145.5 |

* cited by examiner

*Primary Examiner*—Shaun R Hurley
(74) *Attorney, Agent, or Firm*—Sperry, Zoda & Kane

(57) ABSTRACT

A unique formulation for yarn from a novel combination of fibers of polyester and silver which is made by a special manufacturing process including proprietary individual steps. The formed yarn product is durable and useful and can be used to make various fabrics and/or materials and, most particularly, to make final products that possess highly advanced characteristics, particularly fire retardant properties and antimicrobial properties.

17 Claims, No Drawings

PROCESS FOR MANUFACTURING YARN MADE FROM A BLEND OF POLYESTER FIBERS AND SILVER FIBERS

The present utility application hereby formally claims priority of U.S. Provisional Patent application No. 61/133,762 filed Jul. 2, 2008 "Yarn Made From A Blend Of Polyester And Silver Fibers And A Process For Manufacturing Thereof " filed by the same inventor listed herein, namely, I. Michael Indiano, and said referenced provisional application is hereby formally incorporated by reference as an integral part of the present application.

BACKGROUND OF THE INVENTION

1. Field of the Invention

The present invention relates to the general field of manufacturing of yarn made from various component materials, usually fibrous materials, and improved processes for manufacturing such yarns is such a manner that it is stable to facilitate weaving therewith and has unique antimicrobial characteristics and is substantially fire retardant. These yarns, made under such conditions, can be utilized for various purposes such as forming woven fabrics and other materials and can be formed with various characteristics depending upon the specific different fibers utilized in the process for making of the yarn. These processes can be used to make fine count yarns. More particularly, the present invention related to yarns used for making fabrics which are fire retardant as well as being capable of destroying or inhibiting the growth of various types of undesirable microorganisms.

2. Description of the Prior Art

A number of different yarn compositions and manufacturing processes for making yarns and carding machines used in these processes have been patented such as shown in U.S. Pat. No. 2,245,359 patented Jun. 10, 1941 to C. G. Perry on "Yarn Making"; and U.S. Pat. No. 3,251,178 patented May 17, 1966 to J. Stirling on an "Apparatus For Making Rope Strand Or Yarn"; and U.S. Pat. No. 3,347,727 patented to E. Bobkowicz et al on Oct. 17, 1967 and assigned to Emilian Bobkowicz; and U.S. Pat. No. 3,998,988 patented Dec. 21, 1976 to A. Shimomai et al and assigned to Teijin Limited on a "Conjugate Fiber, Fibrous Material And Fibrous Article Made Therefrom And Process For Production Thereof"; and U.S. Pat. No. 4,017,942 patented Apr. 19, 1977 to M. Clayton et al and assigned to The English Card Clothing Company on a "Textile Carding"; and U.S. Pat. No. 4,042,737 patented Aug. 16, 1977 to K. F. Forsgren et al and assigned to Rohm and Haas Company on a "Process For Producing Crimped Metal-Coated Filamentary Materials, And Yarns And Fabrics Obtained Therefrom"; and U.S. Pat. No. 4,388,370 patented Jun. 14, 1983 to V. S. Ellis et al and assigned to Imperial Chemical Industries Limited on "Electrically-Conductive Fibres"; and U.S. Pat. No. 4,756,941 patented Jul. 12, 1988 to F. P. McCullough et al and assigned to The Dow Chemical Company on a "Method And Materials For Manufacture Of Anti-Static Carpet And Backing"; and U.S. Pat. No. 5,234,720 patented Aug. 10, 1993 to R. D. Neal et al and assigned to Eastman Kodak Company on a "Process Of Preparing Lubricant-Impregnated Fibers"; and U.S. Pat. No. 5,372,739 was patented Dec. 13, 1994 to R. D. Neal et al and assigned to Eastman Chemical Company on a "Lubricant-Impregnated Fibers, Lubricant, And Processes For Preparation Thereof"; and U.S. Pat. No. 5,549,957 patented Aug. 27, 1996 to E. J. Negola et al on a "Bulked Continuous Filament carpet Yarn"; and U.S. Pat. No. 5,677,058 patented Oct. 14, 1997 to R. D. Neal et al and assigned to Eastman Chemical Company on a "Lubricant Impregnated Fibers And Processes For Preparation Thereof"; and U.S. Pat. No. 6,035,493 patented Mar. 14, 2000 to W. C. Carlton on a "Textile Carding And Relevant Apparatus"; and U.S. Pat. No. 6,723,428 patented Apr. 20, 2004 to S. W. Foss et al and assigned to Foss Manufacturing Co., Inc. on "Anti-Microbial Fiber And Fibrous Products"; and U.S. Pat. No. 6,815,060 patented Nov. 9, 2004 to Y. Yuuki and assigned to Asahi Kasei Kabushiki Kaisha on "Spun Yarn"; and U.S. Pat. No. 6,841,244 patented Jan. 11, 2005 to S. W. Foss et al and assigned to Foss Manufacturing Co., Inc. on "Anti-Microbial Fiber And Fibrous Products"; and U.S. Pat. No. 6,946,196 patented Sep. 20, 2005 to S. W. Foss and assigned to Foss Manufacturing Co., Inc. on "Anti-Microbial Fiber And Fibrous Products".

SUMMARY OF THE INVENTION

The novel concepts set forth in the present patent application are used to form unique yarns capable of being both fire retardant as well as being antimicrobial. The composition of the fibers used for the yarn in this application combines the benefits of a polyester material component with a silver component. This unique combination of fibrous staple formed into yarn according to the process disclosed herein forms yarn from a fiber mixture including 94% polyester staple mixed with 6% silver staple. The fabric strength and fire retardancy are primarily provided by the polyester component and the antimicrobial characteristic is provided primarily by the silver component.

It is important that the polyester fiber chosen for yarn manufacturing herein have a high level of fire retardancy. One readily available high quality 100% polyester fiber is sold under the trade name, Trevira 350 CS FR provides this quality. This polyester fiber stable is sold with uniquely advanced levels of fire retardancy required in certain applications of products made from the yarn of the present invention, such as those items utilized in hospitals.

Initially the polyester fiber staple and silver fiber staple are physically mixed together at a ratio of 94% to 6%, respectively, in a large container. The contained mixture is then sprayed with a liquid ceramic which initially helps form a physical mixture of the component fibers with the liquid ceramic material.

This moderately mixed polyester and silver fibrous mixture is then removed from the container in batches each normally being approximately 20 to 100 pounds per batch of material. These batches of this ceramic coated fibrous mixture are then placed in a uniquely configured carding machine which has very large teeth for gently and slowly opening of the fibers of the polyester and silver components such that a completely homogeneous mixture of these two fibrous components and the liquid ceramic spray can be achieved. This mixing step forms the fully opened fibrous mixture into a completely homogeneous blend of the various components. Carding can often take as many as two individual carding steps and can take as long as a period of one to two hours or less to finally formed the fully opened and homogeneously blended staple mixture.

The machine used for carding utilizes a uniquely configured card, sold commercially under the trade name "Wolf card", which utilizes unusually large teeth to prevent damaging of the individual component fibers and, in particular, prevents damaging of the silver fibers while at the same time achieving a fully opened and blended homogeneous final mixture of all the component fibers as required prior to spinning.

The opened and blended fiber mixture is then spun into yarn using a sequence of individual steps. The finally formed yarn is coated with a paraffin and ceramic wax mixture. The paraffin component of the mixture lubricates the spinning yarn to allow it to be easily used to make fabrics or other materials and also facilitates winding of this final yarn onto cones.

The ceramic material sprayed on the unblended fibers in the vat is defined herein as a first ceramic material and is quite different from the ceramic sprayed on the yarn after blending which is defined herein as the second ceramic. After final scouring or heating this first ceramic material chemically reacts with the second ceramic material responsive to heating thereof to form tiny platelets over the external surface of the polyester and silver fibrous blend for binding and sealing thereof by encapsulating it. Neither the first ceramic material nor the second ceramic material can be absorbed into the fibers due to the nature of the polyester and silver blended materials and, thus, they reacts together to molecularly bond and encapsulate the yarn in order to maintain the overall integrity of the structure of the yarn. This bonding between the first and second ceramic materials is activated by the subsequent hot scouring or steam heating of the finally formed yarn to a temperature of approximately 180 degrees in a heating chamber. This heating causes the first and second ceramic materials to bond together chemically into platelets encapsulating the yard and thus stabilizing the yarn structure.

It is an object of the present invention to provide a yarn made from a homogeneous blend of Trevira brand 350 CS FR 100% polyester fiber and silver fibers.

It is an object of the present invention to provide a yarn made from a unique combination of polyester and silver by a novel process not known heretofore.

It is an object of the present invention to provide a blend of individual fibers of 100% polyester and silver having a limited length normally between 30 and 60 millimeters individually.

It is an object of the present invention to provide a yarn made from a blend of Trevira 350 CS FR brand polyester staple and silver fiber staple at a ratio of 94 to 6, as well as a process for manufacturing thereof wherein the finally formed yarn is substantially capable of destroying or inhibiting the growth-of microorganisms while also being substantially flame retardant.

It is an object of the present invention to provide a unique process for making a uniquely formed yarn made from a novel carding machine utilizing a Wolf card with oversized teeth which allows for a slow and gentle processing of the fiber mixture for opening and blending of the individual component fibers to facilitate forming of a finally blended material which is completely homogeneous while at the same time preventing the damaging of the silver fiber staple component or other fibrous component thereof while also preventing the silver from agglomerating.

It is an object of the present invention to provide a yarn made from a blend of polyester and silver as well as a process for manufacture thereof wherein a paraffin and ceramic wax mixture is applied to the finally formed yarn to facilitate lubrication thereof and to facilitate encapsulating thereof to fix the structural integrity of the resultant yarn.

It is an object of the present invention to provide a yarn made from a blend of polyester and silver and a process for manufacturing thereof wherein the finally formed yarn is heat scoured with steam within the heating chamber to a temperature of as high as 180 degrees Fahrenheit to chemically bind a first ceramic component with a second ceramic component to encapsulated and stabilize the finally formed yarn structure.

DETAILED DESCRIPTION OF THE PREFERRED EMBODIMENT

The present invention provides a unique composition for a yarn composition made from a blend of polyester and silver, as well as a novel sequence of processing steps for the manufacturing thereof. This preferred embodiment describes herein is only a single example of the unique construction for yarn combining this above-described blend. This disclosure illustrates only a example of a novel type of processing that can be utilized for the manufacturing of such yarn. It should be appreciate that other similar steps can be included in other similar methods and still come within the general overall contemplated concept of the present disclosure herein for the method of producing yarn shown herein as well as for the composition of the yard so produced.

Usually the blend from which the yarn of the present invention is made will include polyester fiber staple which can be purchased in fiber lengths of approximately 30 to 60 millimeters in length. This specific length is preferred but other lengths somewhat outside of the range defined above will also provide usable. The choice of fiber length can be carefully chosen in order to be able to produce fine count yarn if required for a specific application. Silver stock fiber is then purchased in longer fiber lengths which is then cut to be complementary to the length chosen for the polyester staple. As such, normally the various component fibers used for form the yarn of this invention will include fibers all having approximately the same length, but this requirement can vary significantly depending upon the application and use for the finally formed yarn.

The polyester fiber staple used in the present invention will preferably comprise a commercially available Trevira brand 350 CS 100 polyester fiber that has high flame retardancy characteristics. This fibrous material is readily available and is extremely beneficial because it can be used in those applications that require advanced levels of fire retardancy such as hospitals.

In the preferred configuration of the present invention, the polyester Trevira brand fibers, otherwise known collectively as polyester staple, will comprise approximately 94% of the initial mixture of fibers used to ultimately form the yarn. These Trevira polyester fibers will preferably be chosen specifically due to the better flame retardant characteristics thereof. A silver staple component will then be added to an extent such as to comprise approximately 6% of the overall physical mixture of fibers. As such, the preferred overall ratio of polyester Trevira staple to silver staple in the initial mixture of fibrous components will be 94% to 6%, respectively.

The proper initial proportions of polyester staple and silver staple are initially physically placed within a container or large vat and are mixed to a limited extend. This physical mixing preferably is performed manually utilizing a hand tool such as a large wooden spatula, but it should be appreciated that any other means for physically mixing the fiber components together initially can be used. It should be understood that such physical mixing of the fibers has physical limitations due to the fibrous nature of the components and, thus, only a moderately thorough physical mixture can be achieved at this time in the process. Once this moderate mixing of the initial fibrous components within the vat has been completed, the entire content of the vat is then sprayed with a clear translucent liquid ceramic material which comprises a first type of ceramic material. This first ceramic material is quite similar to a paint without a pigment since it is both clear and translucent. This liquid ceramic spraying step coats all portions of the mixture of the fibrous materials throughout the container or vat. These fibrous materials which are now coated with the clear translucent liquid first ceramic spray will then physically be mixed again preferably manually with a wooden spatula in a similar manner as performed previously in order to further mix both the fibers with the liquid first ceramic material sprayed into the vat.

The next step in this process is to initiate the blending of this fiber mixture by opening of the fibers. Forming a homogeneous mixture of such fibrous material is only possible after the fibrous material is made substantially opened such as by carding thereof. Individual batches of any size but preferably 20 pounds to 100 pound of the fiber mixture are removed from the vat and placed into the blending chamber of a textile carding machine. The carding machine for the present invention, preferably, is a Wolf carding machine which uses a type of card having special coarse teeth for the purpose of very gently and slowly opening and blending this mixture of different fibers, some of which can be very delicate, especially the silver staple. This type of carding machine is utilized specifically to open such fibers in order that they can be homogeneously blended together. This opening and homogeneous blending occurs very slowly with the use of such a coarse card in the carding machine and, thus, requires a longer period of time with a number of individual passes of the batches of fibrous material used for effectively opening and blending the, mixture. As many as two individual carding steps may be required over a time period of as long as one to two hours may be needed in order to achieve full and complete homogeneous opening and blending of the fibrous mixture. This considerably long length of time is required due to the fact that a card that is being used for this carding process uses very coarse or open teeth as opposed to a fine toothed card which is normally utilized for other carding processes and achieves mixing and blending faster but treats the blended material more roughly. In the present invention it is important to appreciate that such a fine toothed card can not be utilized because such a card could cause clogging or agglomerating of the silver fibers together which would prevent the thorough mixing thereof homogeneously throughout the overall fibrous mixture.

The Wolf carding machine described in this invention is commonly used for carding other materials such as wool. By modifying the configuration of the teeth to be more coarse, it can be converted such it can be used to provide a slower carding process as needed for the present unique combination of polyester staple and silver staple. Once carding of the mixture in the vat is finalized, then all the fibers will be opened and the final mixture will be completely homogeneous. It is then possible to spin the blended fiber into yarn by a process of sequential steps.

At first the blended homogeneous fiber material is formed into a sliver form which is somewhat tighter than the initial final carded mixture. The consistency of the fibrous mixture is then made further tighter by placing it into a roving form. This roving is then wound onto roving spools or bobbins and it moves into a spinning frame to facilitate spinning directly into the final yarn form. The final spinning step takes the blended fiber which has been formed into sliver and roving and spins it into yarn.

At this stage the yarn needs to be lubricated to facilitate weaving characteristics thereof for forming of fabrics and material and to facilitate winding thereof onto cones. For this purpose a paraffin and ceramic wax mixture is applied onto the spinning yarn as it is wound onto the cones. The paraffin component of the wax mixture lubricates the yarn to enhance knitting characteristics thereof to facilitate use thereof in forming woven materials and products. The paraffin also facilitates the winding of the yarn upon cones. The ceramic component of this ceramic and paraffin coating is chosen to be a second ceramic material which is chosen to be a different type of ceramic as compared to the first ceramic material. The first ceramic material and the second ceramic material are specifically chosen such that when mixed together and heated, these two different types of ceramic material can chemically react to form platelets which will encapsulate the finally formed yarn for enhancing the structural integrity thereof.

The next step in the process to form the yarn is to steam heat the yarn or heat scour it within a heating chamber at a temperature of approximately 180 degrees Fahrenheit which will molecularly bond the first ceramic material to the second ceramic material together in the foil of tiny platelets encapsulating the yarn for stabilizing thereof. As such, the final yarn product is significantly strengthened by the combination of the heat treating of the first and second ceramic materials and is simultaneously lubricated by the paraffin component of the final coating step. In this manner the process of the present invention imparts an anti-microbial characteristic to any products made from the yarn while also maintaining the highly desirable elevated levels of fire and flame retardancy not known or available heretofore in combination with one another in a yarn material.

While particular embodiments of this invention have been described above, it will be apparent that many changes may be made in the form, arrangement, sequencing and positioning of the various elements of the combination of element subject to this patent application. In consideration thereof, it should be understood that preferred embodiments of this invention disclosed herein are intended to be illustrative only and not intended to limit the scope of the invention.

I claim:

1. A process for making yarn having enhanced strength, stability and antimicrobial properties comprising:

A. providing a polyester staple of polyester fibers all having a uniform fiber length of between 30 mm and 60 mm approximately;

B. providing a silver staple of silver fibers;

C. cutting the silver fibers of the silver staple to a uniform fiber length of between 30 mm and 60 mm approximately;

D. forming a fibrous staple compound containing approximately 94% polyester fibers and approximately 6% silver fiber as measured by weight;

E. primary mixing of the fibrous staple compound;

F. coating of the fibrous staple compound with a liquid ceramic material;

G. secondary mixing of the fibrous staple compound;

H. dividing of the fibrous staple compound into individual batches of fibrous staple compound;

I. blending of each of the individual batches of fibrous staple compound in order to further open the fibrous material located therewithin for facilitating more homogenous mixing of the individual fibrous components of the fibrous staple compound; and J. spinning the blended fibrous staple compound for tightening thereof into sliver form of the fibrous staple compound;

K. tightening of the sliver form of the fibrous staple compound into a roving form of the fibrous staple compound;

L. placing of the roving form of the fibrous staple compound onto roving spools;

M. spinning of the roving form of the fibrous compound into yarn;

N. winding of the yarn onto cones while applying of a mixture of paraffin and ceramic wax thereon for lubrication thereof and to facilitate stabilizing thereof; and O. heating of the yarn sufficiently to stabilize the yarn and to molecularly bond the ceramic material thereto for chemically retaining and further bonding together of the various fibers contained within the yarn.

2. The process for making yarn having enhanced strength, stability and antimicrobial properties as defining in claim 1 wherein said mixing of the fibrous staple compound is performed by mechanical mixing thereof.

3. The process for making yarn having enhanced strength, stability and antimicrobial properties as defining in claim 2 wherein said mechanical mixing of the fibrous staple compound is performed by placing of the fiber mixture into a container and manually mixing thereof.

4. The process for making yarn having enhanced strength, stability and antimicrobial properties as defining in claim 1 wherein said coating of the fibrous staple compound with a liquid ceramic material is performed by applying of a translucent liquid ceramic material.

5. The process for making yarn having enhanced strength, stability and antimicrobial properties as defining in claim 1 wherein said coating of the fibrous staple compound with a liquid ceramic material is performed by spraying of a liquid ceramic material thereupon.

6. The process for making yarn having enhanced strength, stability and antimicrobial properties as defining in claim 1 wherein said secondary mixing of the fibrous staple compound is performed by secondary mechanical mixing thereof.

7. The process for making yarn having enhanced strength, stability and antimicrobial properties as defining in claim 6 wherein said secondary mechanical mixing of the fibrous staple compound is performed by placing of the fiber mixture into a container and manually mixing thereof.

8. The process for making yarn having enhanced strength, stability and antimicrobial properties as defining in claim 1 wherein said dividing of the fibrous staple compound into individual batches of fibrous staple compound is performed by providing individual batches of fibrous staple compound each having a weight of approximately 20 to 100 pounds.

9. The process for making yarn having enhanced strength, stability and antimicrobial properties as defining in claim 1 wherein said blending of the individual batches of fibrous staple compound in order to open the fibers located therewithin is performed in a textile carding machine.

10. The process for making yarn having enhanced strength, stability and antimicrobial properties as defining in claim 9 wherein said blending of each of the individual batches of fibrous staple compound in order to further open the fibrous material located therewithin for facilitating more homogenous mixing of the individual fibrous components of the fibrous staple compound is performed by passing each individual batch of fibrous staple compound through the textile carding machine a plurality of times.

11. The process for making yarn having enhanced strength, stability and antimicrobial properties as defining in claim 9 wherein said blending of individual batches of fibrous staple compound is performed in a textile carding machine configured utilizing a coarse textile card.

12. The process for making yarn having enhanced strength, stability and antimicrobial properties as defining in claim 1 wherein said blending of each of the individual batches of fibrous staple compound in order to further open the fibrous material located therewithin for facilitating more homogenous mixing of the individual fibrous components of the fibrous staple compound is performed by passing each individual batch of fibrous staple compound through the textile carding machine at least twice.

13. The process for making yarn having enhanced strength, stability and antimicrobial properties as defining in claim 1 wherein placing of the roving form of the fibrous staple compound onto roving spools is performed by placing onto roving bobbins.

14. The process for making yarn having enhanced strength, stability and antimicrobial properties as defining in claim 1 wherein said spinning of the roving form of the fibrous compound into yarn is performed using a spinning frame.

15. The process for making yarn having enhanced strength, stability and antimicrobial properties as defining in claim 1 wherein said heating of the yarn is performed to approximately 180 degrees Fahrenheit.

16. The process for making yarn having enhanced strength, stability and antimicrobial properties as defining in claim 1 wherein said heating of the yarn is performed by steam heating thereof.

17. A process for making yarn having enhanced strength, stability and antimicrobial properties comprising:

A. providing a polyester staple of polyester fibers all having a uniform fiber length of between 30 mm and 60 mm approximately;

C. providing a silver staple of silver fibers;

D. cutting the silver fibers of the silver staple to a uniform fiber length of between 30 mm and 60 mm approximately;

E. forming a fibrous staple compound containing approximately 94% polyester fibers and approximately 6% silver fiber as measured by weight;

F. primary mixing of the fibrous staple compound mechanically and manually;

G. coating of the fibrous staple compound with a liquid ceramic material wherein said coating of the fibrous staple compound with a liquid ceramic material is performed by spraying of a translucent liquid ceramic material thereupon;

H. secondary mixing of the fibrous staple compound mechanically and manually;

I. dividing of the fibrous staple compound into individual batches of fibrous staple compound each having a weight of approximately 20 pounds to 100 pounds;

J. blending of each of the individual batches of fibrous staple compound in a textile carding machine a plurality of separate times in order to further open the fibrous material located therewithin for facilitating more homogenous mixing of the individual fibrous components of the fibrous staple compound; and K. spinning the blended fibrous staple compound using a spinning frame for tightening thereof into sliver form of the fibrous staple compound;

L. tightening of the sliver form of the fibrous staple compound into a roving form of the fibrous staple compound;

M. placing of the roving form of the fibrous staple compound onto roving spools;

N. spinning of the roving form of the fibrous compound into yarn;

O. winding of the yarn onto cones while applying of a mixture of paraffin and ceramic wax thereon for lubrication thereof and to facilitate stabilizing thereof; and P. steam heating of the yarn to approximately 180 degrees Fahrenheit to stabilize the yarn and to molecularly bond the ceramic material thereto for chemically retaining and further bonding together of the various fibers contained within the yarn.

* * * * *